US009596948B1

(12) United States Patent
McGinnis

(10) Patent No.: US 9,596,948 B1
(45) Date of Patent: Mar. 21, 2017

(54) FREE-STANDING SLATWALL

(71) Applicant: MEGAWALL, INC., Comstock Park, MI (US)

(72) Inventor: Brad McGinnis, Ada, MI (US)

(73) Assignee: MEGAWALL, INC., Comstock Park, MI (US)

( * ) Notice: Subject to any disclaimer, the term of this patent is extended or adjusted under 35 U.S.C. 154(b) by 482 days.

(21) Appl. No.: 13/761,016

(22) Filed: Feb. 6, 2013

(51) Int. Cl.
*A47F 5/00* (2006.01)

(52) U.S. Cl.
CPC ..... *A47F 5/00* (2013.01)

(58) Field of Classification Search
CPC ..... A47F 5/103; A47F 5/0853; A47F 5/0807; A47F 5/101; A47F 5/10; A47F 5/0846; A47F 5/00; A47B 96/04
USPC ..... 211/87.01, 94.01
See application file for complete search history.

(56) References Cited

U.S. PATENT DOCUMENTS 3,044,632 A * 7/1962 Schild ..... 108/92
3,209,709 A * 10/1965 Shoffner ..... 108/27
3,352,428 A * 11/1967 Sak et al. ..... 211/106.01
3,626,870 A * 12/1971 Schild ..... 108/108
3,766,696 A * 10/1973 Totoonchie ..... E04B 1/6162 52/241
4,055,253 A * 10/1977 Oztekin ..... 211/189
4,224,769 A * 9/1980 Ball ..... A47B 21/06 312/140.1
4,323,163 A * 4/1982 Johns ..... 211/189
4,785,946 A * 11/1988 Sorensen ..... 211/187
5,412,912 A * 5/1995 Alves ..... 52/36.5
5,566,844 A * 10/1996 Bernardin ..... 211/189
5,607,070 A * 3/1997 Hellyer ..... 211/189
5,941,026 A * 8/1999 Eisenreich et al. ..... 52/36.5
6,047,838 A * 4/2000 Rindoks et al. ..... 211/187
6,164,467 A 12/2000 DePottery et al.
6,349,507 B1 2/2002 Muellerleile
6,763,957 B1 7/2004 Mullerleile
D533,283 S 12/2006 Holztrager
7,270,242 B2 * 9/2007 Liu ..... 211/189
7,461,484 B2 * 12/2008 Battey et al. ..... 52/220.7
8,033,404 B2 * 10/2011 Keller ..... 211/94.01
8,146,754 B2 * 4/2012 Apgood et al. ..... 211/94.01
8,752,718 B2 * 6/2014 Stukenberg et al. ..... 211/87.01
2008/0000861 A1 1/2008 Muellerleile

* cited by examiner

*Primary Examiner* — Patrick Hawn
(74) *Attorney, Agent, or Firm* — Shlesinger, Arkwright & Garvey LLP

(57) ABSTRACT

A free-standing slatwall comprises first and second posts supported in vertical positions, the first and second posts having respective inner walls facing each other; first and second vertical members attached to the respective inner walls; and slatwall panel having first and second vertical edge portions attached to the respective first and second vertical members.

17 Claims, 6 Drawing Sheets

FIG. 10
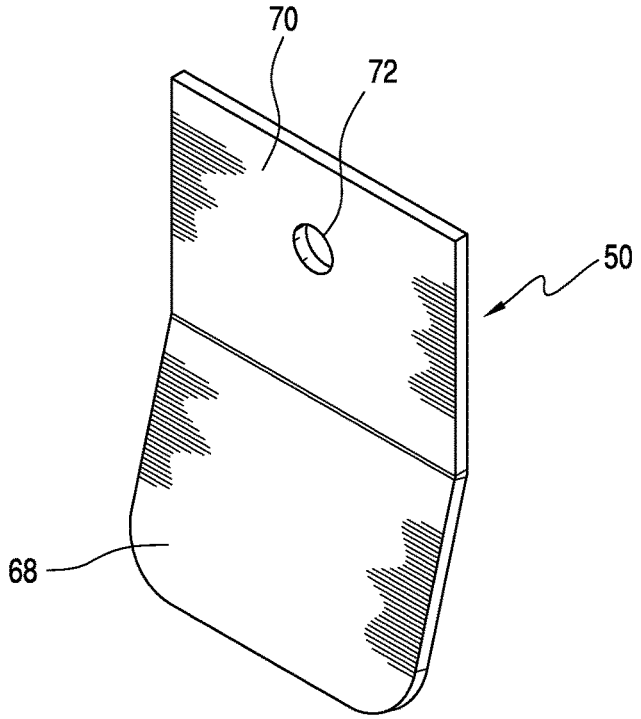
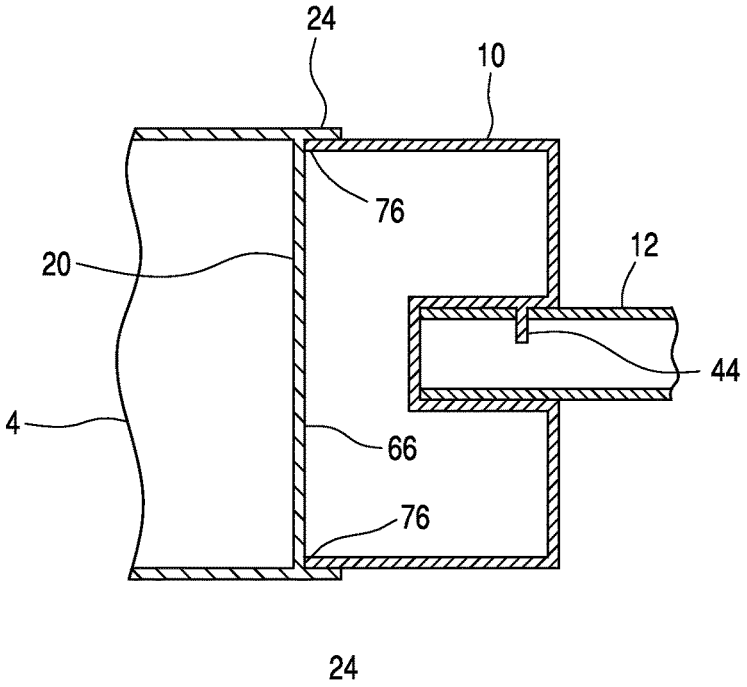
FIG. 11

FREE-STANDING SLATWALL

FIELD OF THE INVENTION

The present invention is generally directed to a slatwall for displaying merchandise and particularly to a free-standing slatwall.

SUMMARY OF THE INVENTION

A free-standing slatwall comprises first and second posts supported in vertical positions, the first and second posts having respective inner walls facing each other; first and second vertical members attached to the respective inner walls; and slatwall panel having first and second vertical edge portions attached to the respective first and second vertical members.

BRIEF DESCRIPTION OF THE DRAWINGS

FIG. 10 is a perspective view of a male clip used in the present invention.

FIG. 11 is a partial cross-sectional view taken along line 10-10 in FIG. 1A.

DETAILED DESCRIPTION OF THE INVENTION

Figure 1B:
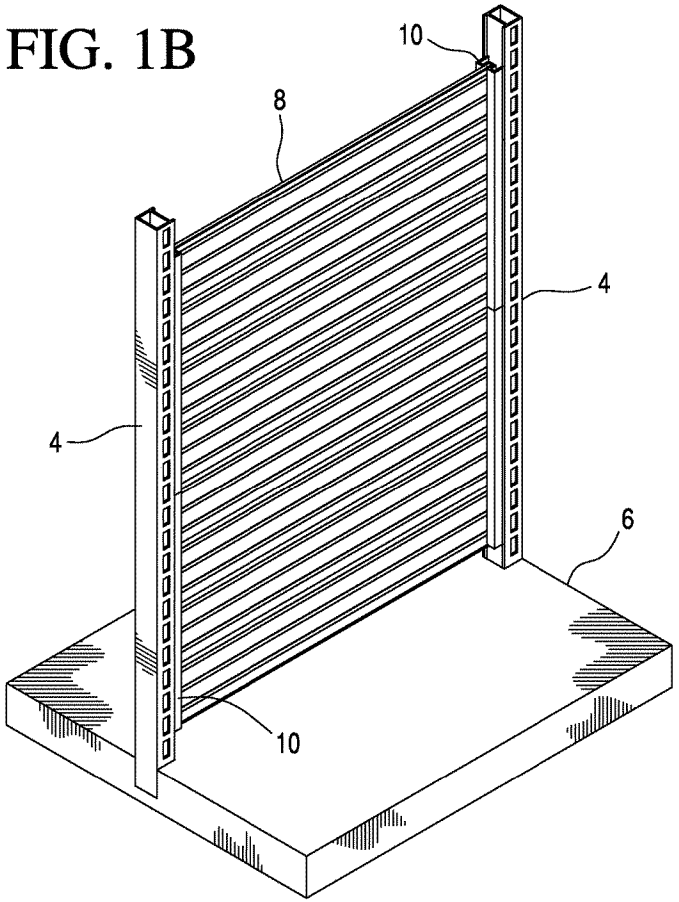
FIG. 1B is a perspective view of another embodiment of the slatwall shown in FIG. 1A.
Figure 1A:
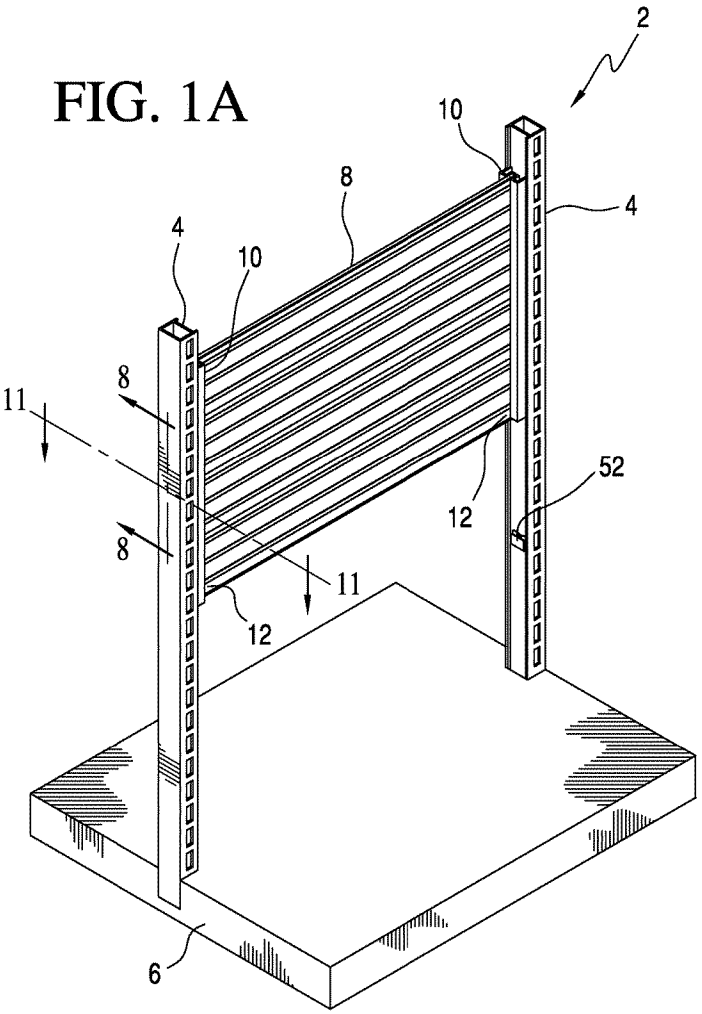
FIG. 1A is a perspective view of a free-standing slatwall embodying the present invention.

A double-sided slatwall 2 embodying the present invention is disclosed FIGS. 1A and 1B. The slatwall 2 includes posts 4 sufficiently supported in the vertical position by a base 6. A slatwall panel 8 is attached to vertical members 10 at its respective vertical edge portions 12. The slatwall panel 8 may be positioned along selected portion of the posts 4, as shown in FIG. 1A, or may extend the length of the posts 4, as shown in FIG. 1B.

Figure 2:
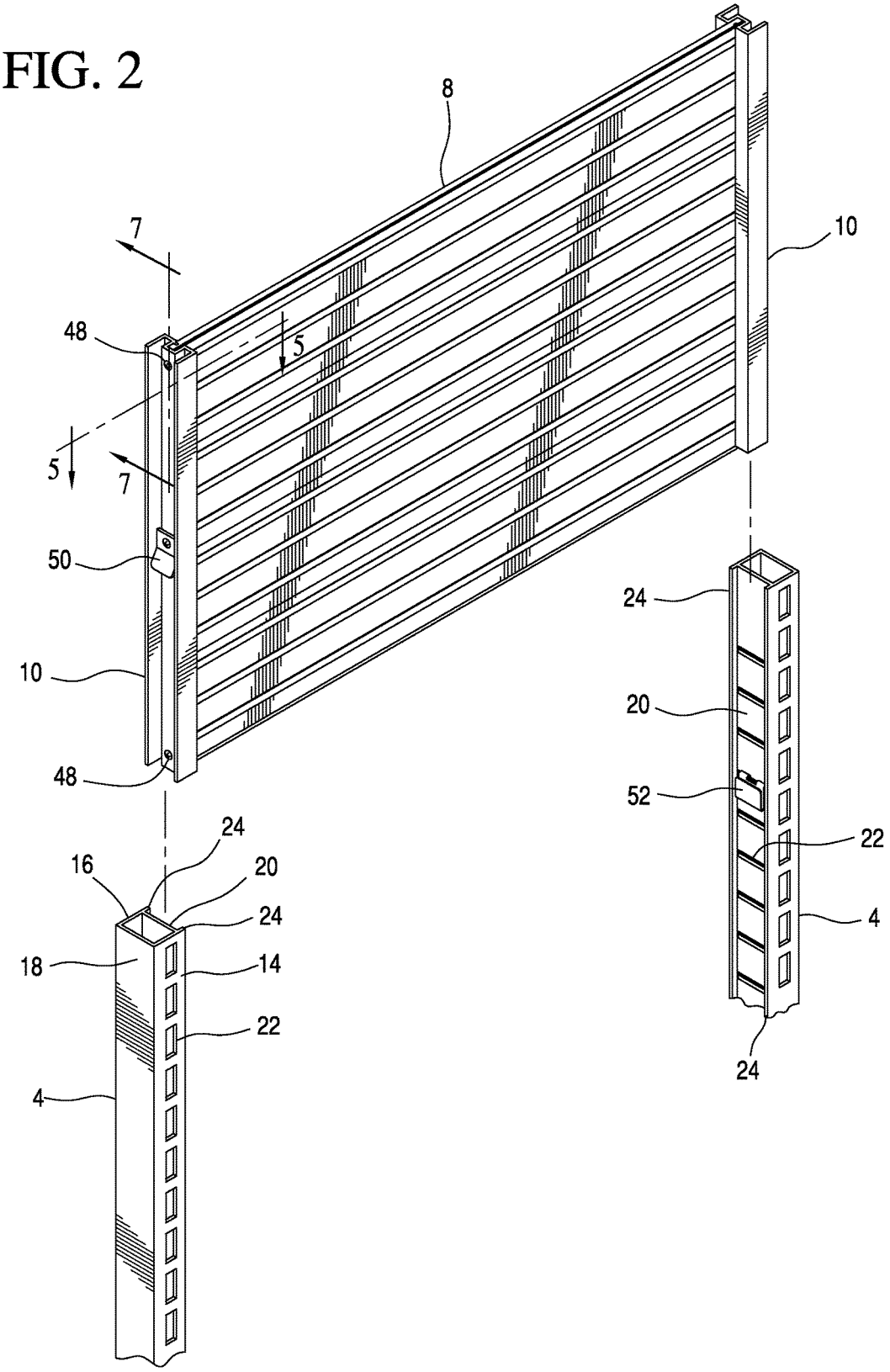
FIG. 2 is an assembly view of the slatwall shown in FIG. 1A.

Referring to FIG. 2, each of the posts 4 is preferably four-side tubular member having front wall 14, rear wall 16, outer wall 18 and inner wall 20. The front and rear walls 14 and 16 may be provided with slots 22 for attaching thereto standard display shelves (not shown). The inner side 20 has a plurality of horizontal slots or half-hoops 22. The post 4 further includes side flanges 24 that extend along the front and rear walls 14 and 16 and extend away from the inner wall 20.

Figure 3:
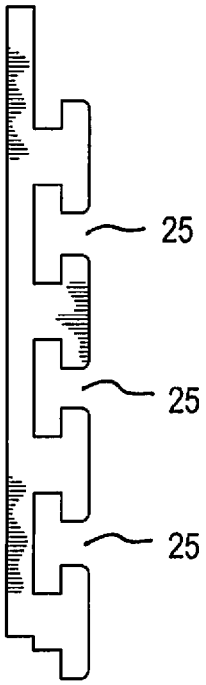
FIG. 3 is an edge view of a one-sided slatwall section for use in the present invention.
Figure 4:
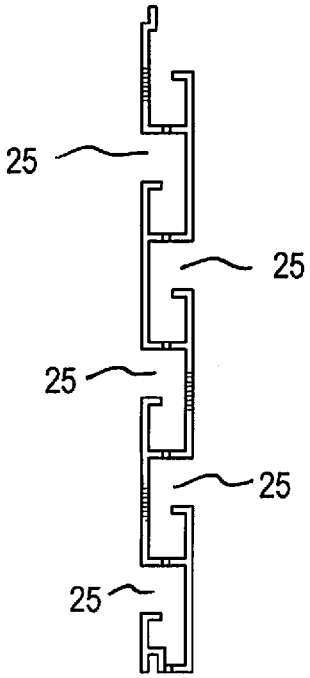
FIG. 4 is an edge of a double-sided slatwall section for use in the present invention.

The slatwall panel. 8 is standard and may be single-sided as shown in FIG. 3 in cross-section or double-sided as shown in cross-section in FIG. 4. The panel 8 includes a plurality of horizontal and parallel partly enclosed recesses 25 adapted to hold standard hanger brackets (not shown) for displaying merchandise. A double-sided slatwall panel will be used in further describing the invention, but it should be understood that a single-sided slatwall panel is equally applicable.

Figure 5:
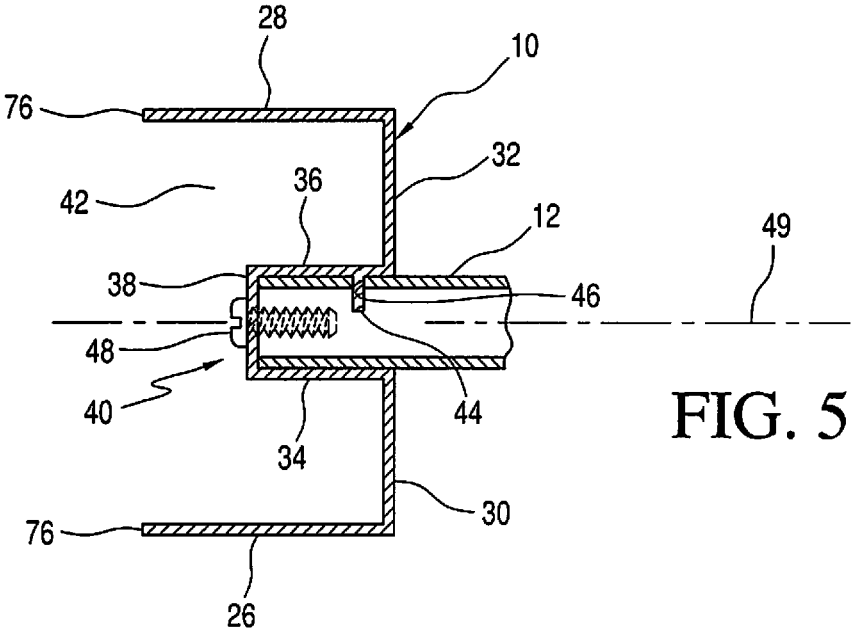
FIG. 5 is a cross-sectional view taken along line 5-5 in FIG. 2.

Referring to FIG. 5, each of the vertical members 10 is hollow and in cross-section includes front wall 26, rear wall 28, side walls 30 and 32, inner walls 34, 36 and 38. The front wall 26 and the rear wall 28 are preferably substantially parallel. The side wall 30 is preferably substantially perpendicular to the front wall 26. Similarly, the other side wall 32 is substantially perpendicular to the rear wall 28. The walls 34, 36 and 38 form a groove 40 that receives a respective edge portion 12 of the slatwall panel 8. The walls 34 and 36 project inwardly into a space 42 partially enclosed by the walls 26, 28, 30 and 32. The walls 34 and 36 are preferably substantially parallel to one another and preferably substantially perpendicular to the respective walls 30 and 32. The wall 38 is preferably substantially perpendicular to the walls 34 and 36. The vertical members 10 are preferably extruded of suitable material, such as metal or plastic.

A projection 44 extends from the wall 36. The projection 44 preferably extends the length of the wall 36. The projection 44 is preferably substantially perpendicular to the wall 36. The projection 44 is configured to interlock with the edge portion of the slatwall panel 8 with a groove 46 that receives the projection 44. The groove 46 is preferably cut into the front at one edge portion 12 and rear side at the other the edge portion 12 of the slatwall panel 8. The groove 46 may also be cut on the same side of the slatwall panel 8. A screw 48 secures the slatwall panel 8 with respect to the vertical member 10 in the vertical direction. The vertical member 10, except for the projection 44, is preferably symmetrical about an axis 49.

Figure 6:
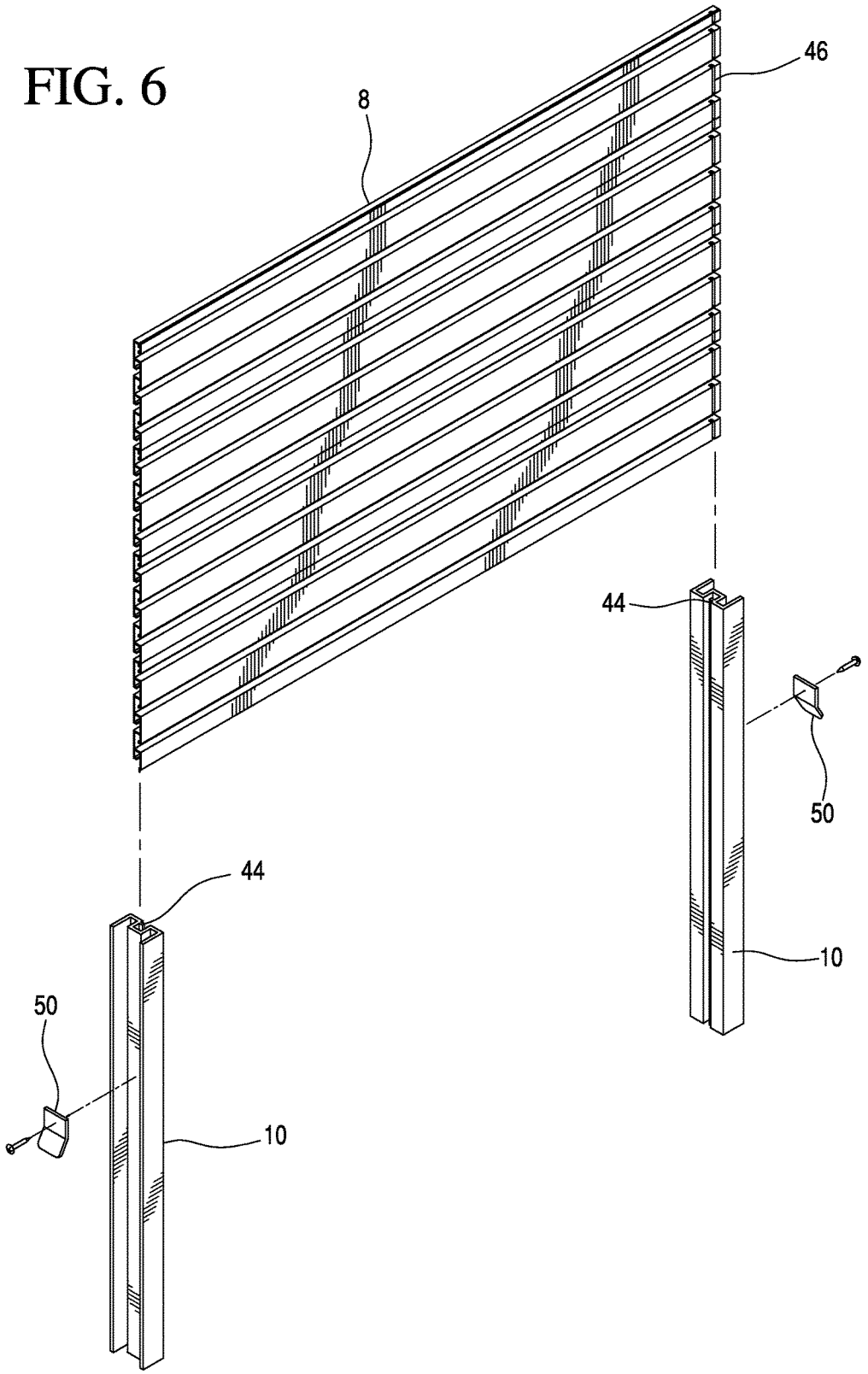
FIG. 6 is an assembly view of the slatwall subassembly shown in FIG. 2.

Referring to FIG. 6, the slatwall panel 8 is attached to the vertical members 10 by sliding the projections 44 into the respective grooves 46 disposed at each end portion 12 (the other groove 46 is behind the front of the slatwall panel 8 and is, therefore, not visible). This places the edge portions 12 inside the respective grooves 40 and interlocks the slatwall panel 8 to the vertical members 10 in the horizontal direction. The slatwall panel 8 is secured to the vertical members 10 in the vertical direction with screws 48 (see FIGS. 2, 5 and 7).

Referring back to FIG. 2, the vertical members 10 are attached to the respective posts 4 with male clips 50 and female clips 50. Only one male clip 50 and one female clip 52 are shown in this view, but it should be understood that that female clip 52 not visible in the view is to receive the visible male clip 50. Similarly, the visible female clip 52 is understood to receive a male clip not visible in the view.

Figure 7:
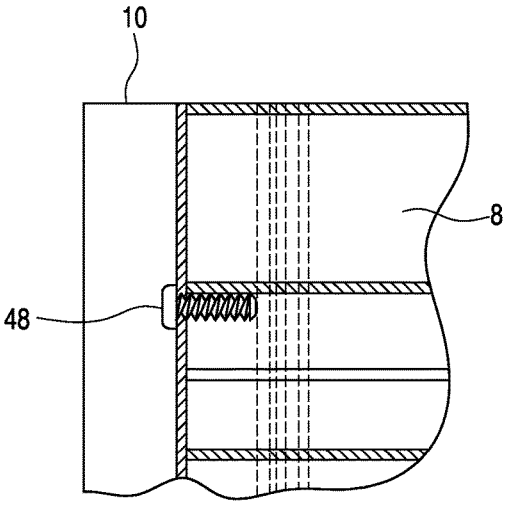
FIG. 7 is a cross-sectional view taken along line 7-7 in FIG. 2.

Referring to FIGS. 5 and 7, the slatwall panel 8 is attached to the vertical member 10 by screws 48 in the vertical direction.

Figure 8:
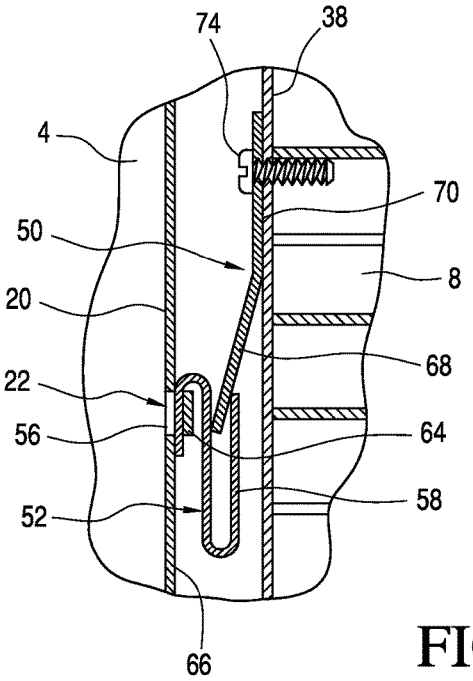
FIG. 8 is a cross-section view taken along line 8-8 in FIG. 1A.

Referring to FIG. 8, the female clip 52 is attached to the post 4 through the slot 22 which is cut out from the inner wall 20 of the post 4. The slot 22 may preferably be a half-hoop 56, which is a strip of expanded metal cut from the inner wall 20 of the post 4.

Figure 9A:
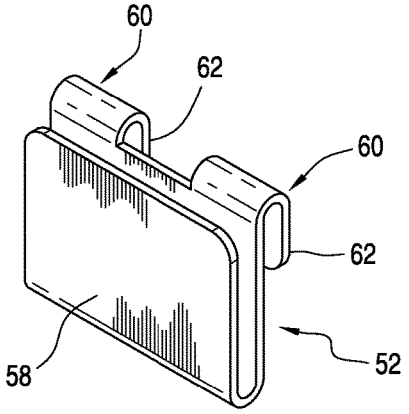
FIG. 9A is a perspective view of a female clip used in the present invention.
Figure 9B:
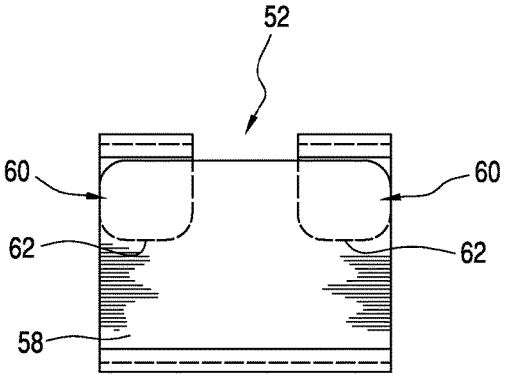
FIG. 9B is a front view of the female clip shown in FIG. 8A.

Referring to FIGS. 9A and 9B, the female clip 52 is preferably made from sheet metal bent into a U-shaped portion 58 for receiving the male clip 50 and two U-shaped portions 60 for insertion into the slot 22 or half-hoop 56. The portions 60 are spaced apart from each other for easier insertion into the half-hoop 56. The portions 60 include leg portions 62 that are inserted and wedged into the semi-hoop 56 such that the leg portions 62 are disposed between the rear side 64 of the semi-hoop 56 and the outer surface 66 of the inner wall 20.

Referring to FIG. 10, the male clip 50 is preferably made from sheet metal having a ramp plate portion 68 bent at an obtuse angle relative to a flat plate portion 70, preferably substantially at 165°. A hole 72 is used for receiving a screw 74 for attaching the male clip 50 to the wall 38 of the vertical member 10. The male clip 50 when received within the female clip 52 is configured to bias the respective vertical member 10 to the respective post 4 to create a tight abutment between the outer edges 76 of the vertical member 10 and the outer surface 66 of the respective post 4, as shown in FIG. 11. The resulting structure advantageously provides lateral stability between the posts 4 without requiring additional braces. The side flanges 24 advantageously provide front-to-back stability to the vertical members 10, as shown in FIG. 11.

Referring back to FIG. 8, it should be understood that the ramp plate portion 68 would be forced to the bottom of the U-shaped portion 58, causing the ramp plate portion 68 to bias the vertical member 10 toward the post 4 for a tight connection. The male clips 50 and the female clips 52 are preferably made of flexible and resilient material, such as spring metal.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A free-standing slatwall, comprising:

a) first and second posts supported in vertical positions, said first and second posts have respective inner walls facing each other;

b) first and second vertical members attached to respective said inner walls, said first and second vertical members are supported by respective said first and second posts; said first and second posts include respective front and rear walls; side flanges extending along respective said front and rear walls away from respective said inner walls; said first and second vertical members are disposed between respective said flanges;

c) slatwall panel having a plurality of horizontal and parallel partly enclosed recesses for displaying merchandise, said slatwall panel having first and second vertical edge portions attached to respective said first and second vertical members;

d) said first and second posts each including a first clip; and e) said first and second vertical members each including a second clip cooperating with respective said first clip to attach said first and second vertical members to respective said first and second posts.

2. A free-standing slatwall as in claim 1, wherein:

a) said first clip is a female clip; and b) said second clip is a male clip; receivable within respective said female clip when said first and second vertical members are attached to respective said first and second posts.

3. A free-standing slatwall as in claim 2, wherein:

a) said female clip includes first and second U-shaped portions;

b) said first U-shaped portion is secured to respective said first and second posts; and c) said second U-shaped portion is for receiving respective said male clip.

4. A free-standing slatwall as in claim 3, wherein:

a) said male clip includes first and second plate portions;

b) said first plate portion is attached to respective said first and second vertical members; and c) said second plate portion is received within said second U-shaped portion of respective said female clip when said first and second vertical members are attached to respective said first and second posts.

5. A free-standing slatwall as in claim 4, wherein said second plate portion extends outwardly from respective said first and second vertical members.

6. A free-standing slatwall as in claim 3, wherein:

a) said first and second posts each includes a number of vertically spaced slots; and b) said first U-shaped portion is received within a selected one of said vertically spaced slots.

7. A free-standing slatwall as in claim 1, wherein:

a) said first and second vertical members each includes a groove; and b) said first and second vertical edge portions are received within a respective groove.

8. A free-standing slatwall as in claim 7, wherein:

a) said groove includes first and second opposed walls;

b) a projection extends from one of said first and second opposed wall;

c) said slatwall includes vertical slots on said first and second vertical edge portions; and d) said projection is received within respective said slots when said slatwall is attached to said first and second vertical members.

9. A free-standing slatwall as in claim 8, wherein:

a) one of said vertical slots is disposed on a front side of said first vertical edge portion; and b) the other of said vertical slots is disposed on a rear side of said slatwall panel at said second vertical edge portion.

10. A free-standing slatwall as in claim 8, wherein said projection is substantially perpendicular to said one of said first and second opposed walls.

11. A free-standing slatwall as in claim 8, wherein said projection extends along the length of said respective first and second vertical members.

12. A free-standing slatwall as in claim 1, wherein said first and second vertical members are made from extruded material.

13. A free-standing slatwall as in claim 1, wherein:

a) said first and second vertical members in cross-section each includes first and second opposed side walls;

b) third and fourth opposed sides walls disposed between said first and second opposed side walls;

c) first transverse wall connecting said first and third opposed side walls;

d) second transverse wall connecting said fourth and second opposed side walls; and e) third transverse wall connecting said third and fourth opposed side walls.

14. A free-standing slatwall as in claim 13, wherein:

a) said first, second, third and fourth opposed side walls are parallel; and b) said first, second and third transverse walls are substantially perpendicular to said first, second, third and fourth opposed side walls are parallel.

15. A free-standing slatwall as in claim 2, wherein said male clip is adapted to bias said respective first and second vertical members toward respective said first and second posts when said male clip is received within respective said female clip.

16. A free-standing slatwall as in claim 1, wherein said first and second posts have front and rear faces with slots for securing brackets.

17. A free-standing slatwall as in claim 1, wherein said slatwall panel is double-sided.

* * * * *